US005496133A

United States Patent [19]

Sciarretti

[11] Patent Number: 5,496,133

[45] Date of Patent: Mar. 5, 1996

[54] TRANSPORT ASSEMBLY FOR PUMP AND DISCHARGE LINE

[76] Inventor: Louis Sciarretti, 6303 Champlain Ter., Davie, Fla. 33331

[21] Appl. No.: 417,833

[22] Filed: Apr. 6, 1995

[51] Int. Cl.[6] ..... E02B 13/00

[52] U.S. Cl. ..... 405/52; 166/241.7; 166/65.1; 417/231; 405/36

[58] Field of Search ..... 405/52, 303, 36, 405/50; 166/65.1, 241.1–241.7; 417/231

[56] References Cited

U.S. PATENT DOCUMENTS

| | | | |
|---|---|---|---|
| 2,798,435 | 7/1957 | Armstrong | 417/231 |
| 3,757,387 | 9/1973 | Bush et al. | 166/241.7 |
| 3,905,725 | 9/1975 | Johnson | 417/231 |
| 3,966,361 | 6/1976 | House | 417/231 |
| 4,083,657 | 4/1978 | Misener | 417/4 |
| 4,570,715 | 2/1986 | Van Meurs et al. | 166/65.1 X |
| 4,603,737 | 8/1986 | Spikes | 166/65.1 X |
| 4,611,656 | 9/1986 | Kendall et al. | 166/65.1 |
| 5,255,739 | 10/1993 | Neuroth et al. | 166/65.1 |

FOREIGN PATENT DOCUMENTS

| | | | |
|---|---|---|---|
| 2206612 | 8/1973 | Germany | 417/231 |

*Primary Examiner*—Dennis L. Taylor
*Attorney, Agent, or Firm*—Jacobson, Price, Holman & Stern

[57] ABSTRACT

A water table lowering assembly includes a discharge line connected to a submersible pump. At least two brackets are secured along the length of the discharge line. A cable is connected at one end to the submersible pump. The cable extends parallel to the discharge line and is connected to the at least two brackets spaced along the discharge line. The opposite end of the cable from the end connected to the pump is formed into a loop through which a hook secured to a backhoe or other lifting apparatus is secured. The backhoe lifts the assembly of the pump and discharge line into a vertical orientation so as to lower the pump, followed by a succeeding length of discharge line, through the opening of a manhole and into a collection basin. Water collected in the collection basin is evacuated by the submersible pump so as to lower the water table surrounding the collection basin.

7 Claims, 2 Drawing Sheets

TRANSPORT ASSEMBLY FOR PUMP AND DISCHARGE LINE

FIELD OF THE INVENTION

The present invention relates to the transport of a discharge line connected to a submersible pump by lifting of the pump, discharge line and at least two brackets around the discharge line by a cable connected to the pump and the at least two brackets. The thereby formed assembly is inserted into a manhole of a collection basin in a vertical orientation.

BACKGROUND OF THE INVENTION

It is often necessary, particularly at a new construction site, to lower the water table at the construction site so that underground utility lines can be installed. The water table is usually lowered by a submersible sludge or suction pump which is manually lowered through a manhole of a water collection basin within which water collects.

Connected to the pump is a suction or discharge line which carries water discharged from the pump to an above-ground location for proper drainage. Oftentimes, in the placement of the pump in the water collection basin, the discharge line and connected pump are dragged along with the hydraulic hoses providing power to the pump to the collection basin and are manually lowered through the manhole into the collection basin. During this process, the discharge line and the hydraulic hose can be dragged along the ground and/or come in contact with the side edge of the manhole and are often damaged or weakened, leading to a possible break in the discharge line or hydraulic hose lines.

A procedure has not been developed for safely transporting and lowering a submersible pump and discharge line through a manhole of a collection basin without damage to the discharge line and hydraulic hose lines.

SUMMARY OF THE INVENTION

Accordingly, it is a primary object of the present invention to reinforce a discharge line connected to a submersible pump so as to lift the discharge line vertically and maintain the discharge line in a vertical orientation as the discharge line, the submersible pump and its hydraulic hoses are transported and lowered through a manhole into a collection basin.

This object is accomplished by securing at least two brackets along the length of the discharge line. One end of the discharge line is connected to the submersible pump. A cable is connected at one end to the submersible pump. The cable extends parallel to the discharge line and is connected to the at least two brackets spaced along the discharge line. The opposite end of the cable from the end connected to the pump is formed into a loop through which a hook secured to a backhoe or other lifting apparatus is secured.

The backhoe lifts the assembly of the pump and discharge line into a vertical orientation so as to lower the pump, followed by a succeeding length of discharge line, through the opening of a manhole and into a collection basin. Water collected in the collection basin is evacuated by the submersible pump so as to lower the water table surrounding the collection basin.

The discharge line is wire reinforced along its length to aid in the stiffening of the discharge line above the uppermost bracket. The discharge line is preferably 17 feet long but the length may be varied according to the depth of the collection basin into which the pump is lowered and the distance required to deliver discharged water away from the construction site.

The cable is preferably made of steel having a diameter in the range of ⅜ to ½ inch. A cable, associated with a 17 foot long discharge line, would preferably be 23 feet long or of sufficient length to lift the discharge line into a vertical orientation.

The at least two brackets spaced along the discharge line also accommodate hydraulic hoses leading from the pump to a compressor. The brackets each include two hydraulic hose connectors, one being externally threaded at both ends and the other being internally threaded at both ends. The brackets and their hydraulic hose connectors facilitate transfer of hydraulic fluid through the various sections of hydraulic hose which power the pump.

Accordingly, it is another object of the present invention to include at least two brackets along a discharge line which is connected to a submersible pump so as to connect a cable to the pump and the brackets for lowering the discharge line vertically into a manhole of a collection basin.

It is still yet another object of the present invention to include at least two brackets along a discharge line which is connected to a submersible pump so as to connect a cable to the pump and the brackets for lowering the discharge line vertically into a manhole of a collection basin with the brackets including hydraulic hose connectors for accepting connection of sections of hydraulic hose with the hydraulic hose sections being maintained in a vertical orientation along with the discharge line.

It is still yet another object of the present invention to include at least two brackets along a discharge line which is connected to a submersible pump so as to connect a cable to the pump and the brackets for lowering the discharge line vertically into a manhole of a collection basin with the brackets including hydraulic hose connectors for accepting connection of sections of hydraulic hose with the hydraulic hose sections being maintained in a vertical orientation along with the discharge line with the cable extending between the pump at one end and forming a loop at an opposite end for lifting by a backhoe, for example, to vertically lower the discharge line through the manhole of the collection basin.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figures 1, 2:
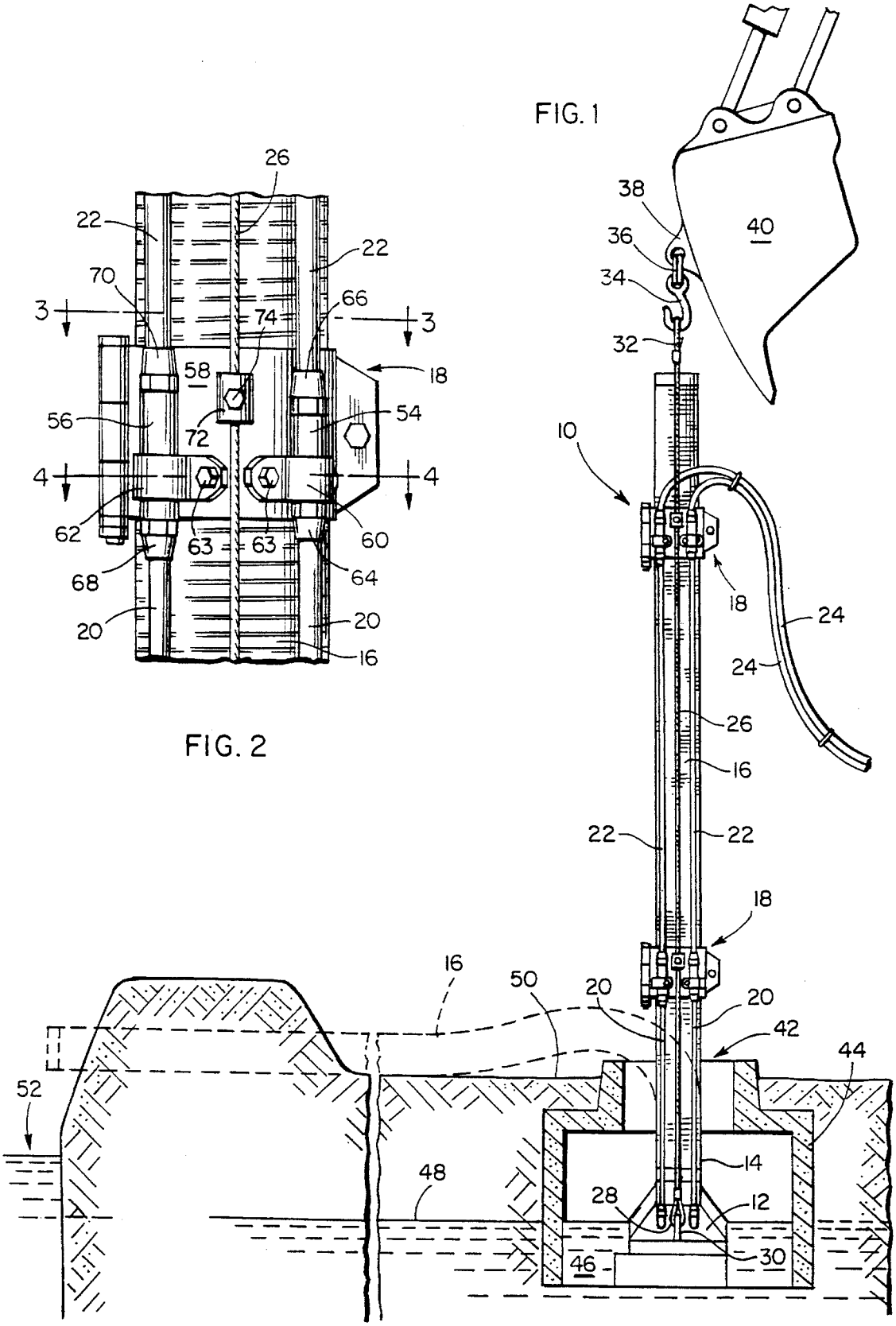
FIG. 1 is a side elevational view illustrating the lowering of a vertically oriented discharge line through a manhole of a collection basin by the bucket of a backhoe and illustrating in dotted lines the location of the discharge line after vertically lowering the discharge line and its pump vertically into the collection basin.
FIG. 2 is an enlarged side elevational view of a bracket secured on the discharge line and the hydraulic hose connectors forming part of the bracket as well as a connector for securing a cable to the bracket.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, to FIG. 1 in particular, a transport assembly for a submersible pump and discharge line is generally designated as 10. With reference to its orientation in FIG. 1, the assembly includes a submersible pump 12 connected at one end 14 of a discharge line 16. The pump may be a 6 inch sludge pump, Model FP6 available from Sloan Pump Company, Inc. of Fort Lauderdale, Fla. The discharge line 16 is preferably a six to seven inch diameter pipe made of rubber with a reinforcing wire helically wound in the rubber.

Connected at spaced locations along the length of the discharge line are at least two brackets 18. Brackets 18 connect various lengths of hydraulic hose sections 20, 22, 24 from the pump 12 to a compressor (not shown). The brackets are also used to secure a cable 26 which extends from one end 28 which is secured to a bracket 30 of the pump 12 to an opposite end 32 which forms a loop. The loop formed at end 32 of cable 26 is used to hook the cable 26 onto a hook 34 secured by rings 36 to a bracket 38 of a backhoe bucket 40.

By the use of a backhoe or other lifting apparatus, such as a crane, it is possible to transport the pump and its associated discharge line vertically and lower the pump and its associated discharge line vertically through a manhole opening 42 of a collection basin 44. The pump 12 is submerged in water 46 so as to remove the water from the collection basin through the discharge line 16. The water table 48 is thereby lowered so that utility lines can be installed below ground without water filling in the trenches dug to lay the utility lines.

After the pump 12 and discharge line 16 are transported in a vertical orientation and vertically lowered into the collection basin, the discharge line 16 is laid down along the ground 50 as shown in dotted lines so that upon actuation of a compressor, the pump will evacuate water from the collection basin into a drainage area 52. Continued pumping of water from the collection basin 44 will lower the water table.

As shown in FIG. 2, bracket 18 includes two hydraulic hose connectors 54 and 56. The connectors 54, 56 are secured to the sidewall 58 of the bracket 18 by brackets 60, 62, respectively. The brackets 60, 62 are secured to the sidewall 58 by bolts 63. The connectors 54, 56 allow passage of hydraulic fluid through the various lengths of hydraulic hose sections from the pump to the compressor.

Hydraulic hose connector 54 is externally threaded at its opposite ends for securing of a coupling 64 of hydraulic hose section 20 to one end of the connector 54 whereas at the opposite end of the connector 54 a coupling 66 of hydraulic hose section 22 is threadingly engaged with the connector 54.

Connector 56 includes internal threads for threadingly engaging with a coupling 68 of hydraulic hose section 20. The opposite end of the connector 56 threadingly engages connector 70 of hydraulic hose section 22.

Figure 3:
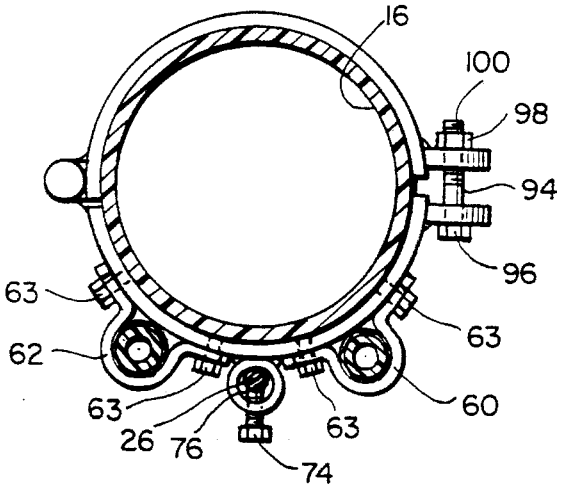
FIG. 3 is a sectional view taken along line 3—3 of FIG. 2

Cable 26 is threaded through a tube 72 welded on the surface 58 of bracket 18. A bolt 74 passes through tube 72 to engage with the cable 26 to secure the cable to the bracket 18. As shown in FIG. 3, the bolt head 74 terminates in end 76 engaging cable 26. The cable secured to the brackets 18 thereby maintain the position of the discharge line 16 with the cable being maintained in a taut condition between the pump and the brackets.

Figure 4:
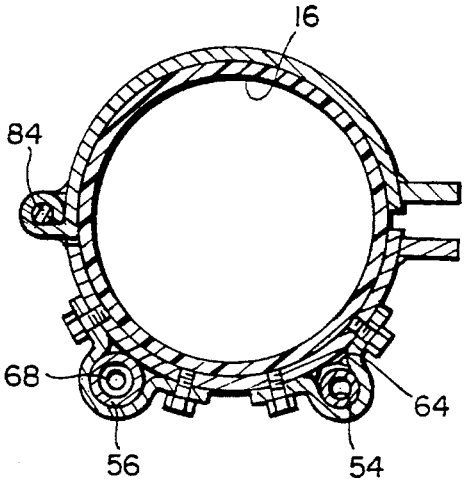
FIG. 4 is a sectional view taken along line 4—4 of FIG. 2.
Figure 5:
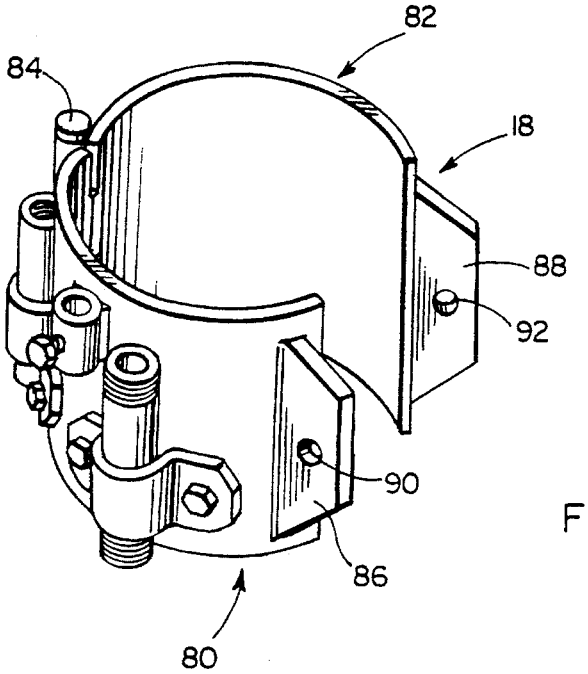
FIG. 5 is a perspective view of a bracket to be secured to a discharge line for securing hydraulic hose sections and a cable to the discharge line so as to locate the discharge line in a vertical orientation during lowering of the discharge line into a collection basin.

As shown in greater detail in FIGS. 3 through 5, each bracket 18 includes two sections 80, 82 which are pivotally connected by pin 84 so that the bracket may be opened and closed around a section of discharge line 16. Two flanges 86, 88 on sections 80, 82, respectively, include holes 90, 92 through which a bolt 94 is passed with the head 96 of the bolt engaging flange 86 and a nut 98 on an opposite end 100 of the bolt 94 engaging the flange 88. As the nut 98 is tightened, the sections 80, 82 of the bracket 18 are secured to the discharge line 16 as reinforced by helically wound wire (not shown).

Sections of hydraulic hose are connected between adjacent brackets 18 on discharge line 16. An uppermost bracket on discharge line 16 provides a hydraulic connection between a compressor and hydraulic hose sections connected to the submersible pump 12.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A water drainage assembly comprising:

a water submersible pump located at a terminal end of the water drainage assembly for evacuating water collected at a construction site, a discharge line connected at one end to said pump for removing water evacuated by said water submersible pump from the construction site, at least two brackets secured to said discharge line, said at least two brackets each including two hydraulic hose connectors positioned on an exterior peripheral surface of said at least two brackets and connecting adjacent sections of hydraulic hose from said water submersible pump extending along said discharge line, and a cable connected to said water submersible pump at one end, said cable being connected to said at least two brackets on said exterior peripheral surface and said cable having an opposite end forming an opposite terminal end of the water drainage assembly for connecting said cable to a lifting apparatus so that said discharge line can be lifted into a vertical orientation at the construction site by lifting said opposite end of said cable.

2. A water drainage assembly as claimed in claim 1, wherein one of said two hydraulic hose connectors includes internally threaded ends and the other of said two hydraulic hose connectors includes externally threaded ends, said hydraulic hose connectors connecting said adjacent sections of hydraulic hose along said discharge line.

3. A system for draining water from a construction site, said system comprising:

a collection basin at the construction site for collecting water at a level of the water table, an opening of said collection basin for gaining access to said collection basin, a water submersible pump, a discharge line connected at one end to said water submersible pump for removing water evacuated by said water submersible pump from said collection basin, at least two brackets mounted on said discharge line, said at least two brackets each including two hydraulic hose connectors positioned on an exterior peripheral surface of said at least two brackets and connecting adjacent sections of hydraulic hose from said water submersible pump extending along said discharge line, a lifting apparatus, and a cable connected to said water submersible pump, said at least two brackets on said exterior peripheral surface and said lifting apparatus for lifting said discharge line into a vertical orientation by said lifting apparatus to vertically lower said discharge line into said collection basin through said opening.

4. A system for draining water from a construction site as claimed in claim 3, wherein one of said two hydraulic hose connectors includes internally threaded ends and the other of said two hydraulic hose connectors includes externally threaded ends.

5. A water drainage assembly comprising:

a water submersible pump located at a terminal end of the water drainage assembly for evacuating water collected at a construction site, a discharge line connected at one end to said water submersible pump for removing water evacuated by said water submersible pump from the construction site, a cable connected at one end to said water submersible pump, and at least two brackets mounted on said discharge line, each of said at least two brackets including two hydraulic hose connectors and a clamp for said cable so that said cable can be clamped to said at least two brackets and hydraulic hose sections can be connected between said water submersible pump and said at least two brackets, said cable having another end forming an opposite terminal end of the water drainage assembly for connecting said cable to a lifting apparatus, said discharge line being liftable into a vertical orientation by said cable for transporting and lowering of said discharge line in a vertical orientation into a collection basin of the construction site so as to remove water from the collection basin by said water submersible pump.

6. A water drainage assembly as claimed in claim 5, wherein one of said two hydraulic hose connectors includes internally threaded ends and the other of said two hydraulic hose connectors includes externally threaded ends.

7. A water drainage assembly as claimed in claim 5, wherein the other end of said cable is in the form of a loop.

* * * * *